US012465827B2

(12) United States Patent
Gosselin et al.

(10) Patent No.: US 12,465,827 B2
(45) Date of Patent: Nov. 11, 2025

(54) PADDLE TECHNOLOGY

(71) Applicant: CRBN Pickleball LLC, Costa Mesa, CA (US)

(72) Inventors: Garrett Gosselin, Costa Mesa, CA (US); Nam Hoai Tran, Hawthorne, CA (US)

(73) Assignee: CRBN Pickleball LLC, Costa Mesa, CA (US)

( * ) Notice: Subject to any disclaimer, the term of this patent is extended or adjusted under 35 U.S.C. 154(b) by 0 days.

(21) Appl. No.: 19/079,379

(22) Filed: Mar. 13, 2025

(65) Prior Publication Data

US 2025/0205569 A1 Jun. 26, 2025

Related U.S. Application Data

(63) Continuation of application No. 18/807,453, filed on Aug. 16, 2024.

(60) Provisional application No. 63/637,812, filed on Apr. 23, 2024, provisional application No. 63/520,604, filed on Aug. 18, 2023.

(51) Int. Cl.
*A63B 59/48* (2015.01)
*A63B 102/08* (2015.01)

(52) U.S. Cl.
CPC ..... *A63B 59/48* (2015.10); *A63B 2102/08* (2015.10); *A63B 2209/02* (2013.01)

(58) Field of Classification Search
CPC .. A63B 59/48; A63B 2102/08; A63B 2209/02
See application file for complete search history.

(56) References Cited

U.S. PATENT DOCUMENTS

| | | | |
|---|---|---|---|
| D150,805 | S | 8/1948 | Pauly |
| D191,405 | S | 9/1961 | Wagner |
| D192,740 | S | 5/1962 | Ziabicki |
| 4,062,541 | A | 12/1977 | Marks |
| 4,262,903 | A | 4/1981 | Naret |
| 4,379,554 | A | 4/1983 | Schuyler et al. |
| D294,639 | S | 3/1988 | Croll |
| D307,930 | S | 5/1990 | Sokol et al. |
| D344,314 | S | 2/1994 | Malkoun |
| 5,350,332 | A | 9/1994 | Yu et al. |
| D359,780 | S | 6/1995 | Sokol et al. |
| D501,521 | S | 2/2005 | Reynolds |
| D765,196 | S | 8/2016 | Bonfigli |
| D827,741 | S | 9/2018 | Bonfigli |
| 10,864,418 | B2 | 12/2020 | Kapheim et al. |
| D918,320 | S | 5/2021 | Torres Porrata et al. |

(Continued)

FOREIGN PATENT DOCUMENTS

| | | | | |
|---|---|---|---|---|
| KR | 20250016699 A | * | 2/2025 | ..... C08K 3/04 |
| WO | WO-2022/217045 A1 | | 10/2022 | |

OTHER PUBLICATIONS

Crbn pickleball (pp. 1-10) google search; google.com; Jun. 10, 2025.

(Continued)

*Primary Examiner* — Jeffrey S Vanderveen
(74) *Attorney, Agent, or Firm* — Mintz Levin Cohn Ferris Glovsky and Popeo, P.C.

(57) ABSTRACT

A pickleball paddle with novel core characteristics and/or materials, and related systems, methods, and articles of manufacture are provided.

35 Claims, 13 Drawing Sheets

(56) References Cited

U.S. PATENT DOCUMENTS

| | | | | |
|---|---|---|---|---|
| D931,961 | S | 9/2021 | Bonfigli | |
| D977,045 | S | 1/2023 | Bonfigli | |
| D999,307 | S | 9/2023 | Bergström | |
| D999,308 | S | 9/2023 | Bergström | |
| D999,309 | S | 9/2023 | Bergström | |
| D999,857 | S | 9/2023 | Gong | |
| 11,964,193 | B2 | 4/2024 | Mazursky et al. | |
| D1,029,158 | S | 5/2024 | Bird et al. | |
| D1,056,097 | S | 12/2024 | Lindström | |
| D1,056,098 | S | 12/2024 | Lindström | |
| D1,057,873 | S | 1/2025 | Zeng | |
| D1,058,728 | S | 1/2025 | Kowalski | |
| D1,060,555 | S | 2/2025 | Cohen et al. | |
| D1,066,532 | S | 3/2025 | Young | |
| 2003/0069096 | A1 | 4/2003 | Lin | |
| 2009/0093326 | A1 | 4/2009 | Goldsmith et al. | |
| 2016/0339312 | A1 | 11/2016 | Bonfigli | |
| 2017/0021247 | A1 | 1/2017 | Marvin | |
| 2021/0252356 | A1* | 8/2021 | Thurman | A63B 59/42 |
| 2023/0149785 | A1 | 5/2023 | Lin | |
| 2024/0058656 | A1 | 2/2024 | Lammer et al. | |
| 2024/0123308 | A1 | 4/2024 | Liu | |
| 2024/0123557 | A1 | 4/2024 | Xu | |
| 2024/0226679 | A1 | 7/2024 | Lin | |
| 2024/0269526 | A1 | 8/2024 | Seidenberg | |
| 2024/0286015 | A1* | 8/2024 | Junkins | A63B 59/42 |
| 2025/0058189 | A1 | 2/2025 | Gosselin et al. | |
| 2025/0073549 | A1 | 3/2025 | Kachiwazaki et al. | |
| 2025/0135307 | A1 | 5/2025 | Luo | |
| 2025/0161771 | A1 | 5/2025 | Kachiwazaki et al. | |
| 2025/0161772 | A1 | 5/2025 | Kachiwazaki et al. | |

OTHER PUBLICATIONS

Crbn pickleball (pp. 11-20) google search; google.com; Jun. 10, 2025.

Crbnpickelball.com; 12 pages, Jun. 10, 2025.

Pickleball paddle (pp. 1-10) google search; google.com; Jun. 10, 2025.

Pickleball paddle (pp. 11-21) google search; google.com; Jun. 10, 2025.

Pickleball paddle with front face holes (pp. 1-10) google search; google.com; Jun. 10, 2025.

Pickleball paddle with front face holes (pp. 11-21) google search; google.com; Jun. 10, 2025.

Forziati, Adam. (Apr. 9, 2025). Foam-core paddles are changing pickleball: Overview of Gen 4. The Kitchen. Retrieved Aug. 21, 2025 from https://thekitchenpickle.com/blogs/gear/gen-4-foam-core-paddles-history-of-paddle-tech# :~: text=What%20makes%20Gen%204%20different,absorbs%20energy%2C%20and%20 ransfers%20power. 4 pages.

Olson, Christopher. (Feb. 6, 2025). CRBN TruFoam Genesis Review. Pickleball Studio. Retrieved Aug. 21, 2025 from https://pickleballstudio.com/blog/crbn-trufoam-genesis-review. 5 pages.

Radnothy, Victoria. (Feb. 4, 2025). Pickleball Central calls CRBN TruFoam Genesis paddles 'the future of pickleball.' Pickleball OpCo LLC. Retrieved Aug. 21, 2025 from https://pickleball.com/gear/pickleball-central-calls-crbn-trufoam-genesis-paddles-the-future-of-pickleball. 2 Pages.

Weaver, Alex E. (Jan. 30, 2025). CRBN TruFoam & The Race to Gen-4 Paddle Tech. The Dink. Retrieved Aug. 21, 2025 from https://www.thedinkpickleball.com/crbn-trufoam-the-race-to-gen-4-paddle-tech/. 11 pages.

* cited by examiner

PADDLE TECHNOLOGY

CROSS-REFERENCE TO RELATED APPLICATIONS

This application is a continuation application of U.S. application Ser. No. 18/807,453, filed on Aug. 16, 2024, which claims priority to U.S. Provisional Application No. 63/520,604, entitled "PADDLE TECHNOLOGY" filed on Aug. 18, 2023, and U.S. Provisional Application No. 63/637,812, entitled "PADDLE TECHNOLOGY" filed on Apr. 23, 2024, and the contents of which are hereby incorporated by reference.

TECHNICAL FIELD

The subject matter described herein relates generally to improved paddles and rackets, and similar devices, particularly to rackets or paddles for activities such as pickleball, as well as methods of making and using the same.

BACKGROUND

Rackets and paddles are used in a variety of activities and sports. Some sports such as pickleball have garnered increased interest in recent years. The paddles used in such activities are made of a variety of materials such as wood, fiberglass, graphite, carbon fiber, etc.

SUMMARY

Described herein generally are newly used materials, and improved components, parts and complete paddles and rackets, as well as methods of making and using the same. The embodiments herein will be described in the context of pickleball paddles, but it should be understood that the materials, designs, components, parts and concepts can be used in paddles and rackets (or articles used to strike a ball or other object) for other activities and sports.

Systems, methods, and articles of manufacture, are provided for a pickleball paddle incorporating in some cases, materials that have not been used in such paddles, as described herein. The use of the designs and materials can provide for paddles with different and/or improved characteristics such durability, weighting, and performance.

Currently, most pickleball paddles included a core and an exterior around the core. The exterior generally includes two sides of the exterior face or head of the paddle, and a handle. The exterior also can include a bumper or wrap around the perimeter or edge of the head or face of the paddle. A common core for many paddles includes a lightweight honeycomb patterned material (See, e.g., FIG. 1) that provides a skeletal support that is lighter in weight due to the honeycomb structure, while retain some structure and strength. The honeycombs commonly are made of materials such as Nomex (a synthetic material developed by DuPont in the 1960s), polypropylene ("PP"), and carbon fiber. The honeycomb provides a "vertical" support structure between the two opposing faces of the paddle or racket.

Among the disclosure herein, provided herein are improved paddles, including with novel core materials and designs. For example, cores using lightweight foam materials. Such materials can include one or more materials. One or more materials can be used. Whether one material is used or multiple materials, the materials can be configured to have different weight and/or density characteristics such that the core can have dual or multiple densities of material.

The details of one or more variations of the subject matter described herein are set forth in the accompanying drawings and the description below. Other features and advantages of the subject matter described herein will be apparent from the description and drawings, and from the claims. While certain features of the currently disclosed subject matter are described for illustrative purposes, it should be readily understood that such features are not intended to be limiting. The claims that follow this disclosure are intended to define the scope of the protected subject matter.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
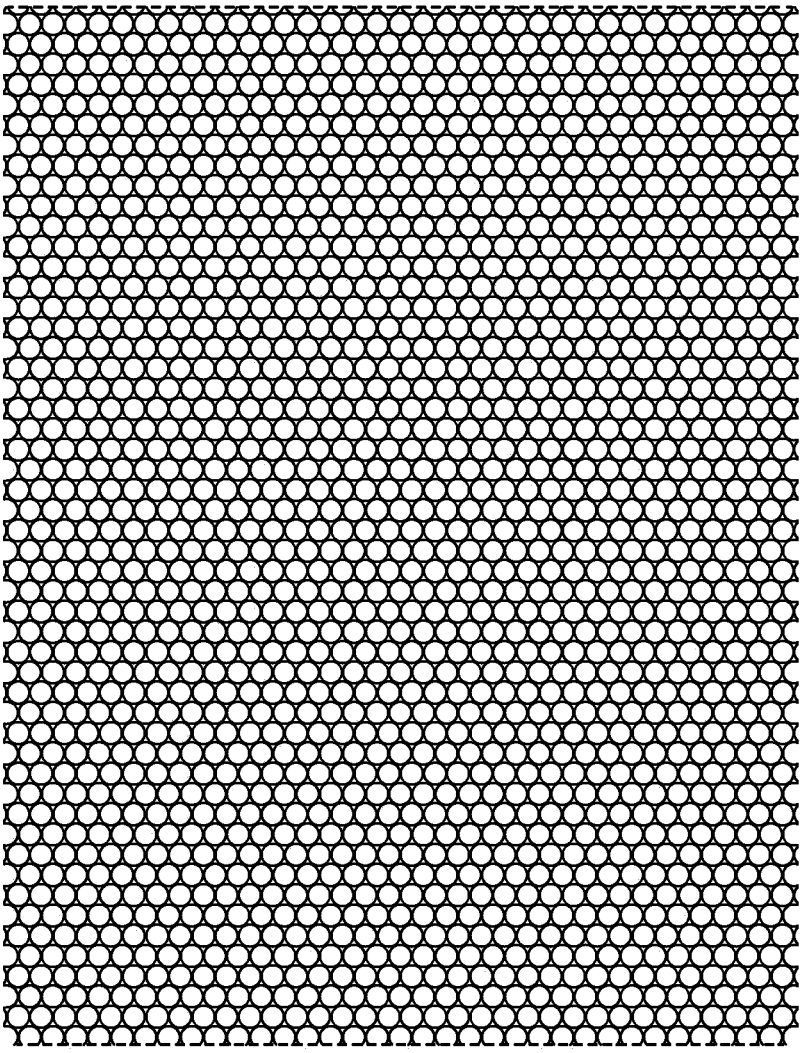
FIG. 1 depicts an example of a common honeycomb core made of polypropylene.

Pickleball paddles may include a contact surface made of a variety of materials, including carbon fiber, among other materials, and a core made of a variety of materials. Pickleball paddles must meet USA Pickleball Association (USAPA) Certification Standards in order to be used in sanctioned tournament play. USAPA Certification Standards for a paddle include certain weight, size, deflection, and durability requirements. Pickleball paddles made of polymer foams, such as an ethylene vinyl acetate (EVA) foam, are lightweight, but excessively deflect, compress, and are not durable. Pickleball paddles made of polypropylene or other dense polymers are rigid and durable, however, weight requirements preclude a pickleball paddle with a solid polypropylene core. To reduce total weight, pickleball paddles can be constructed with a honeycomb core of polypropylene fixed in the core of the paddle, as shown in FIG. 1. It should be understood that while the disclosure herein focuses on pickleball paddles or rackets, improvements, including the use of particular foams and/or the dual density cores, and methods could apply to other types of paddles or rackets that need to be rigid and durable while meeting weight requirements, such as ping pong paddles, Smashball® paddles, bats, padel paddles, and the like.

Consistent with implementations of the current subject matter, the herein described paddle cores, including the dual density core pickleball paddles, can lead to improved performance characteristics, durability and strength. The paddles can be specifically made to be lightweight and durable while undergoing minimal compression and deflection.

Figure 2:
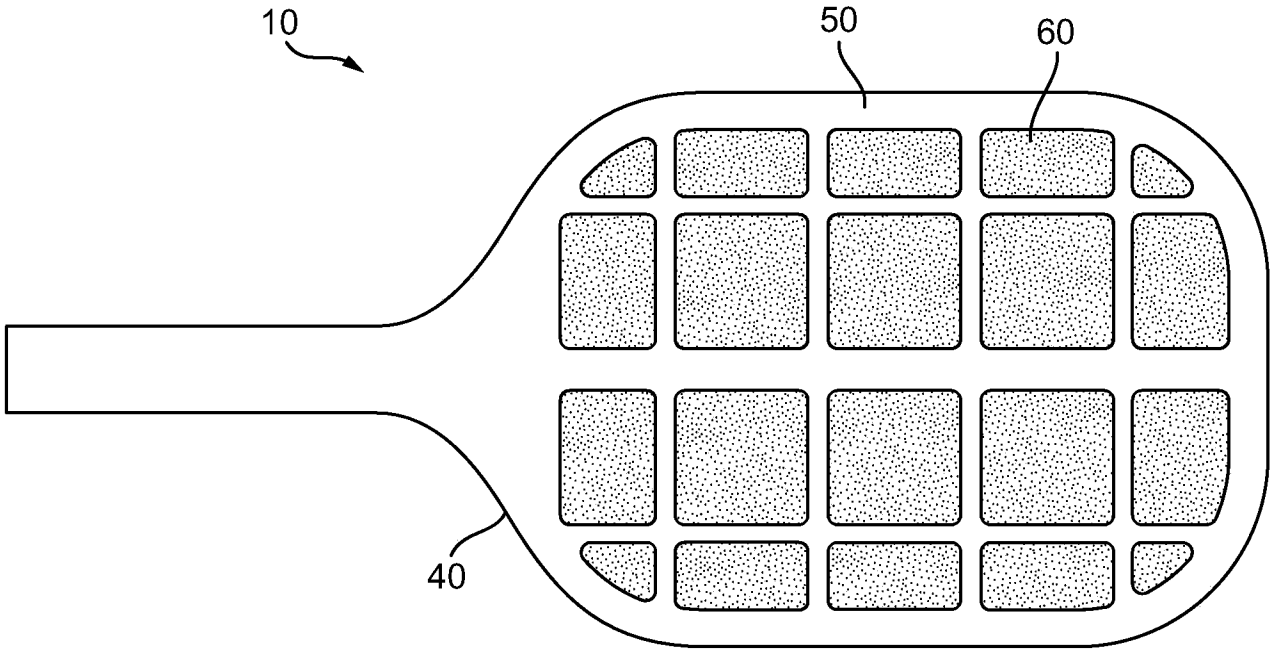
FIG. 2 depicts an example pickleball paddle with a dual density core, consistent with implementations of the current subject matter.
Figure 3:
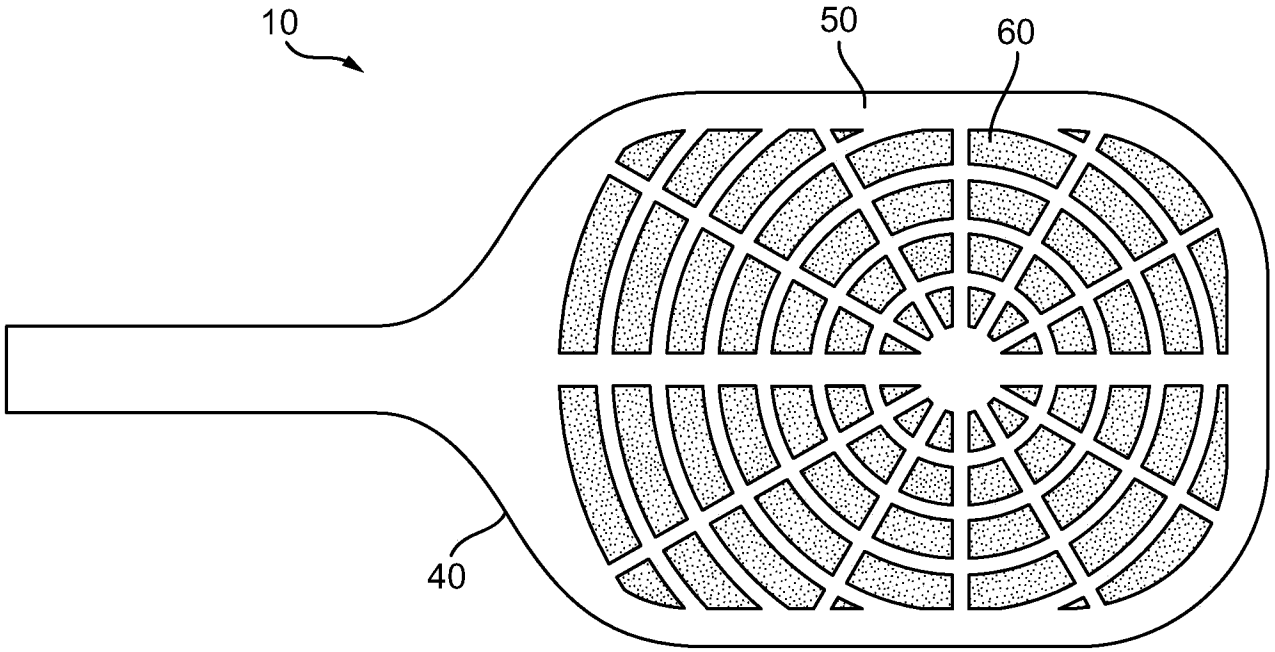
FIG. 3 depicts an example pickleball paddle with a dual density core, consistent with implementations of the current subject matter.

FIGS. 2 and 3 illustrate examples of a dual density core 40 for a pickleball paddle 10 consistent with implementations of the current subject matter. The dual density core 40 can include a frame 50 and filling 60. As shown in FIGS. 2 and 3, frame 50 can be a skeleton frame design that can define cells or regions of different sizes and/or different geometrical shapes, including squares, circles, arches, diamonds, hexagons, honeycomb, and the like. Filling 60 can be located within and fill some or all of the cells/regions of the frame 50. Frame 50 can be made of various materials, such as expanded polypropylene (EPP) (foam), ethylene vinyl acetate (EVA) foam, wood, polymers, other foams, and the like. The material of frame 50 can be a higher density than the material of filling 60. For example, the material of frame 50 can have a density ranging from 5.0 lbs./ft$^3$ to 20.0 lbs./ft$^3$, or any subrange or subvalue there between to the tenths (e.g., 6.0, 6.1, 6.2, 6.3, 6.4, 6.5, 6.6, 6.7, . . . 19.1, 19.2, 19.3, . . . 20.0 lbs./ft$^3$). Filling 60 can be made of various materials, such as EPP, EVA foam, other foams, and the like. For example, the material of filling 60 can have a density ranging from 0.5 lbs./ft$^3$ to 5.0 lbs./ft$^3$, or any subrange or subvalue there between to the tenths (e.g., 1.3, 1.4, 1.5, 1.6, 1.7, 1.8, 1.9. 2.0, 2.1, 2.2, 2.3, 2.4, 2.5, 2.6, 2.7, 2.8, 2.9, 3.0, . . . 4.1, 4.2, 4.3, . . . 5.0 lbs./ft$^3$). The cells of frame 50 can be distributed across the paddle 10 to change the center of mass of the paddle 10. For example, smaller and/or fewer cells (and thus less filling 60) and more material of frame 50 may be located near the base of paddle 10, and larger and/or more cells (and thus more filling 60) and less material of frame 50 may be located near the top of the paddle 10. Manipulation of weight distribution can also be achieved by leaving some cells of frame 50 devoid of filling 60. In embodiments, the filling 60 may be air. The distribution of weight across the paddle 10 can change the performance of the paddle.

Frame 50 and/or filling 60 of core 40 can be composed of high density composite foams such as expanded polypropylene (EPP), ethylene-vinyl acetate (EVA), nanocarbon-containing polymer composite foams (NCP), and/or microcellular polypropylene (MPP). High density composite foams can be used in any combination thereof. For example, components of the frame 50 and/or filling 60 can have foam materials with various densities. Optionally, frame 50, filing 60, or components of the core 40 can be composed of high-density composite foams such as elastomers, polystyrene, polyethylene, polypropylene, polyamide, polyurethane, ethylvinyl-acetate, polyethylene oxide, polyacrylate, cellulose, ethylene vinyl alcohol, polybutylene, polycaprolactone, polycarbonate, polyketone, polyester, polylactic acid, polyvinyl chloride, polyphenylene, and copolymers thereof.

The dual density core 40 for paddle 10 can be manufactured using a CNC milling process. The frame 50 can be CNC milled out of the frame 50 material. The filling 60 can be CNC milled out of the filling 60 material, creating pieces of filling 60 that are shaped to fit into the cells of frame 50. The pieces of filling 60 can be inserted into the cells of frame 50, and the filling 60 and frame 50 can be bonded together with epoxy. The bonded frame 50 and filling 60 can be planed down to a uniform thickness, forming a dual density core 40 to be used in the manufacture of paddle 10.

The dual density core 40 for paddle 10 can be manufactured using an injection molding process, for example. EPP beads can be injection heat molded and can expand and solidify within a mold to form the frame 50. The density of frame 50 can be any suitable density, for example, EPP beads can be selected to produce a frame density ranging, for example, from 6.0 lbs./ft$^3$ to 20.0 lbs./ft$^3$, or any subvalue or subrange therein in tenths. Lower density EPP beads can be injection heat molded into a mold sized for the cells of frame 50 to form cell-shaped pieces of filling 60. The lower density EPP can be selected to produce a filling density ranging from, for example, 1.0 lbs./ft$^3$ to 6.0 lbs./ft$^3$, or any subvalue or subrange therein in tenths. Alternatively, EPS foam, EVA foam, or other foams and fill materials can be selected to produce the desired filling density. The filling 60 can be press fit into the cells of frame 50 and bonded with epoxy. The bonded frame 50 and filling 60 can be planed down to a uniform thickness, forming a dual density core 40 to be used in the manufacture of paddle 10.

Some embodiments relate to articles or devices for striking an object such as a ball. The article or devices can be rackets or paddles, such as for example, a pickleball paddle. While applicable to any of the articles, the following is discussed in the context of a pickleball paddle, but should not be limited thereto.

The paddles 10 can include a core 40, which can include, among other things, a material such as a foam like expanded polypropylene (EPP). EPP is recognized as being a very different material from the more rigid, crystalline polypropylene that is used to form many of the honeycomb cores of many paddles. The EPP that is used can have any suitable density to arrive at a paddle with an overall desired structure and weight. The paddle cores 40 can include, for example, an EPP that has a density of about 0.5 to about 20 lbs./ft$^3$, or any subrange or subvalue to the tenth value there between. The core 40 can include a lower density material 60 to fill in spaces around and adjacent to the skeletal structures 50. Skeletal structures 50 may alternatively be referred to as exoskeleton, frame, or other name designating a structure that provides support to the paddle 10. For example, in most existing paddles that support is provided by a honeycomb structure. Such support structures provide a vertical support between the faces of the paddle. The EPP fill 60 that fills in at least some of the non-skeletal space can have for example, a density of between about 0.5 and about 5.0 lbs./ft$^3$, about 3.5 lbs./ft$^3$, or any subrange or subvalue to the tenth value there between. In some embodiments, the fill material 60 can fill in substantially all of the non-skeletal space within the core 40 of the paddle 10.

In some embodiments the paddles 10 can include a higher density EPP that provides vertical support. Such EPP can have, for example, a density of, for example, between about 5.0 and 20 lbs./ft$^3$, or any subrange or subvalue to the tenth value there between.

In some embodiments the paddles 10 can include EPP having different densities. For example, the paddle 10 can have a skeleton 50 made of the higher density EPP and filler 60 comprising the lower density EPP. In FIGS. 2-3, example structures for the high and low density EPP are depicted. Those densities can be any as described herein. Such a core 40 or paddle 10 may be referred to as a dual density paddle 10 or a dual density core 40.

Figure 4:
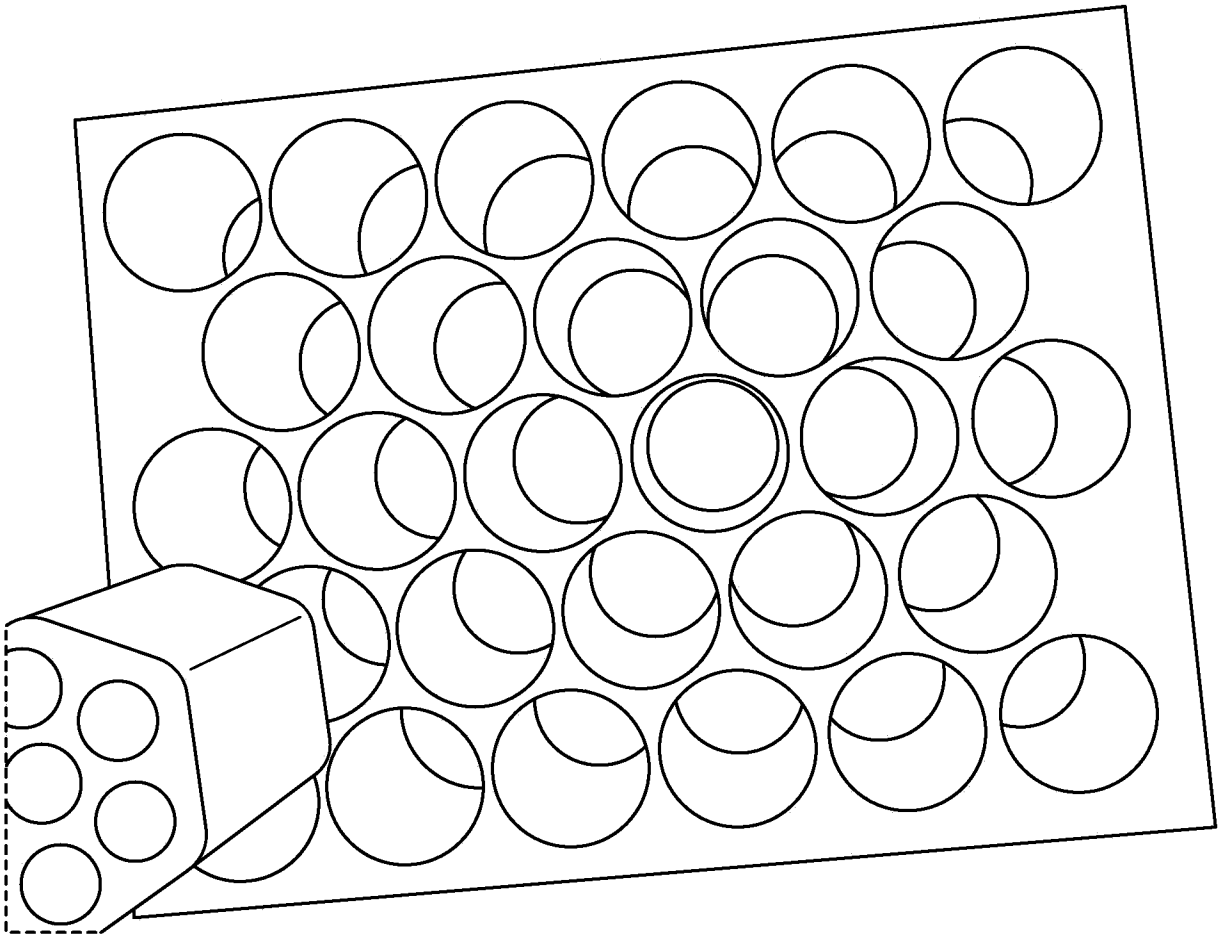
FIG. 4 depicts an example expanded polypropylene EPP foam material that can be used in a paddle core, consistent with implementations of the current subject matter.

FIG. 4 depicts foam that can be used inside of a pickleball paddle. It is envisioned that the shape, size or geometry of the illustrated example is not meant to be limiting, but this figure is to depict an example of the EPP that might be configured and used.

Turning back to FIGS. 2-3, in some embodiments, the skeleton 50 and the fill 60 can be different materials. The paddle 10 or core 40 can have two or more materials, each with a different density, and as such be a dual density core 40 or paddle 10. For example, the skeleton 50 could be wood, carbon fiber, graphite, fiberglass, non-foam polypropylene, and the EPP can be used as the fill material 60 around the skeleton 50. In other embodiments the skeleton 50 can be EPP and one or more different foams and materials can be used for the fill material 60. Examples include EVA foam, polyethylene foams, polyurethanes, and the like. The foams can be open cell or closed cell foams. The foams can be beaded, expanded, cross-linked, or any other variety. In some embodiments, the skeleton 50 and fill 60 can be non-EPP materials that provide adequate support and result in a proper weight and performance. For example, any of the above can be mixed and matched. In embodiments, the fill 60 can be air.

In other embodiments, the total core weight is between about 2.0 and 4.0 ounces, and any subvalue or subrange there between in values to the tenths. The total paddle weight can be between about 5 and 11 ounces, or any subvalue or subrange there between, including values to the tenths. The paddle 10 can further include a face material over the core 40, a grip/handle and optionally a perimeter wrap or bumper/guard (e.g., a rubber or carbon fiber material that optionally can have a foam beading beneath it to provide cushion. The handle can be made of any suitable material. Those can include wood or other materials as described. The handle can be formed as part of the skeleton. The handle can include a grip tape as well for improved gripping and comfort. The faces be made of carbon fiber, graphite, fiberglass or any other suitable material. The faces further can optionally include other coatings, graphics, etc.

The skeleton structure of the paddle can comprise any shape, including, but not limited to those depicted and described herein. For example, the shape could be one as shown in the figures. It could be a honeycomb, including a honeycomb with a cell or hole diameter greater than 10.0 mm. In some embodiments, the cell diameter can be between about 15.0-30.0 mm, for example, or any subvalue or subrange there between to the tenths value. In some embodiments the skeleton 50 can have a uniform structure and/or feature distribution, such as is found in a honeycomb structure. Although other shapes are contemplated. In other embodiments, the structure of the skeleton 50 can be non-uniform or partially uniform, for example as shown in the figures. In some embodiments, the volume of the skeleton 50 can be greater on the perimeter of the paddle 10 than it is in the middle and the fill 60 can fill a greater volume of space in the middle portion, for example. In some embodiments, the volume of the skeleton 50 can be greater in the center or a sweet spot of the paddle 10 than it is on the perimeter and the fill 60 can fill a greater volume of space on the perimeter, as shown in FIG. 3. In other embodiments, the volume distribution or ratio can be more or less uniform. Any distribution ratio is contemplated.

FIGS. 5-13 illustrate various embodiments of a paddle, such as a pickleball paddle built in accordance with the methods described herein. In particular, FIGS. 5-13 shown various examples of a pickleball paddle with varying configurations for the skeleton 50 with gaps filled with air or other materials 60, consistent with implementations of the current subject matter. As shown in FIGS. 5-13, a paddle 10 can include a core 40, skeleton 50, and gaps with fill 60. In some embodiments, the core 40 may be surrounded by a handle or grip 70. The handle 70 can provide a place for a user to hold the paddle. The core 40 may be covered on one or more faces by an outer layer 80. Outer layer 80 can be composed of carbon fiber, fiberglass, graphene, borphene, and/or the like. Outer layer 80 can form a striking surface for a ball such as a pickleball.

Figure 5:
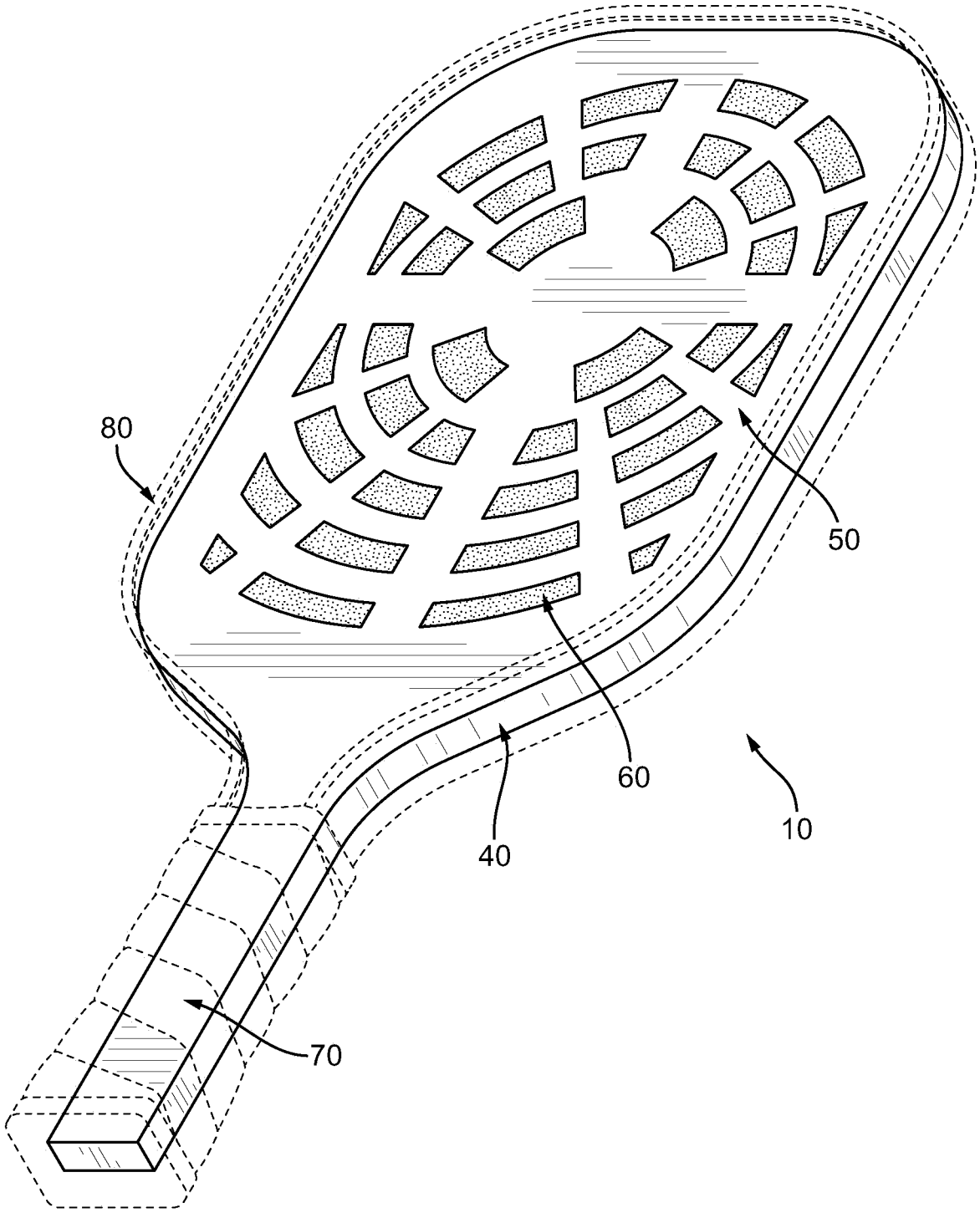
FIG. 5 depicts an example of a pickleball paddle with a first configuration for a skeleton, consistent with implementations of the current subject matter.
Figure 6:
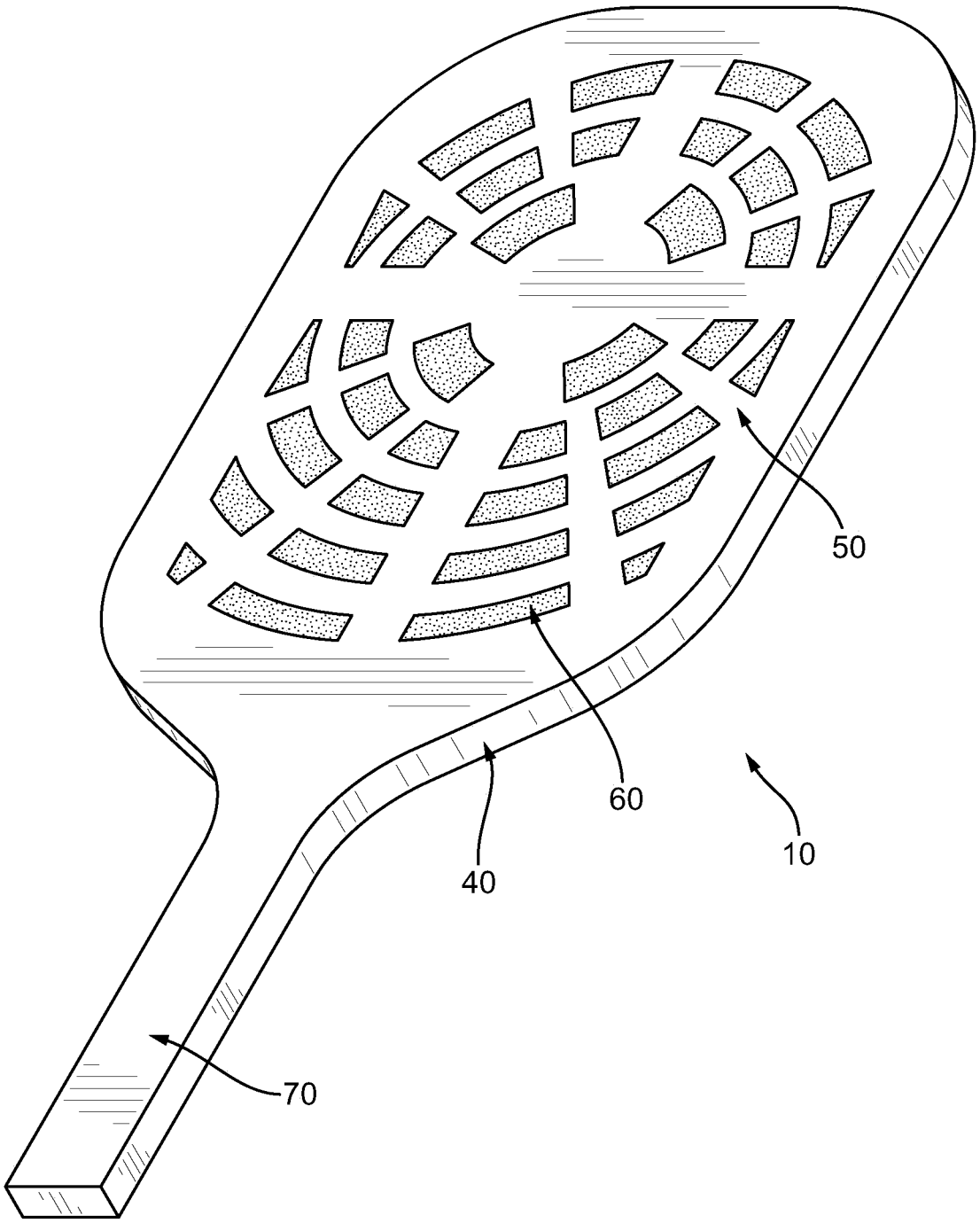
FIG. 6 depicts an example of a pickleball paddle with a second configuration for a skeleton, consistent with implementations of the current subject matter.

As illustrated in FIG. 5, in some embodiments, the skeleton 50 can include a plurality of concentrically arranged gaps filed with a material 60 such as foam. As described above, the arrangement of gaps and fill in the skeleton 50 can modify the center of gravity of the paddle and provide varying advantages or configurations of the paddle when playing pickleball or the like. FIG. 6 provides a second image of the embodiment shown in FIG. 5 with the handle or grip 70 and outer layer 80 removed.

Figure 7:
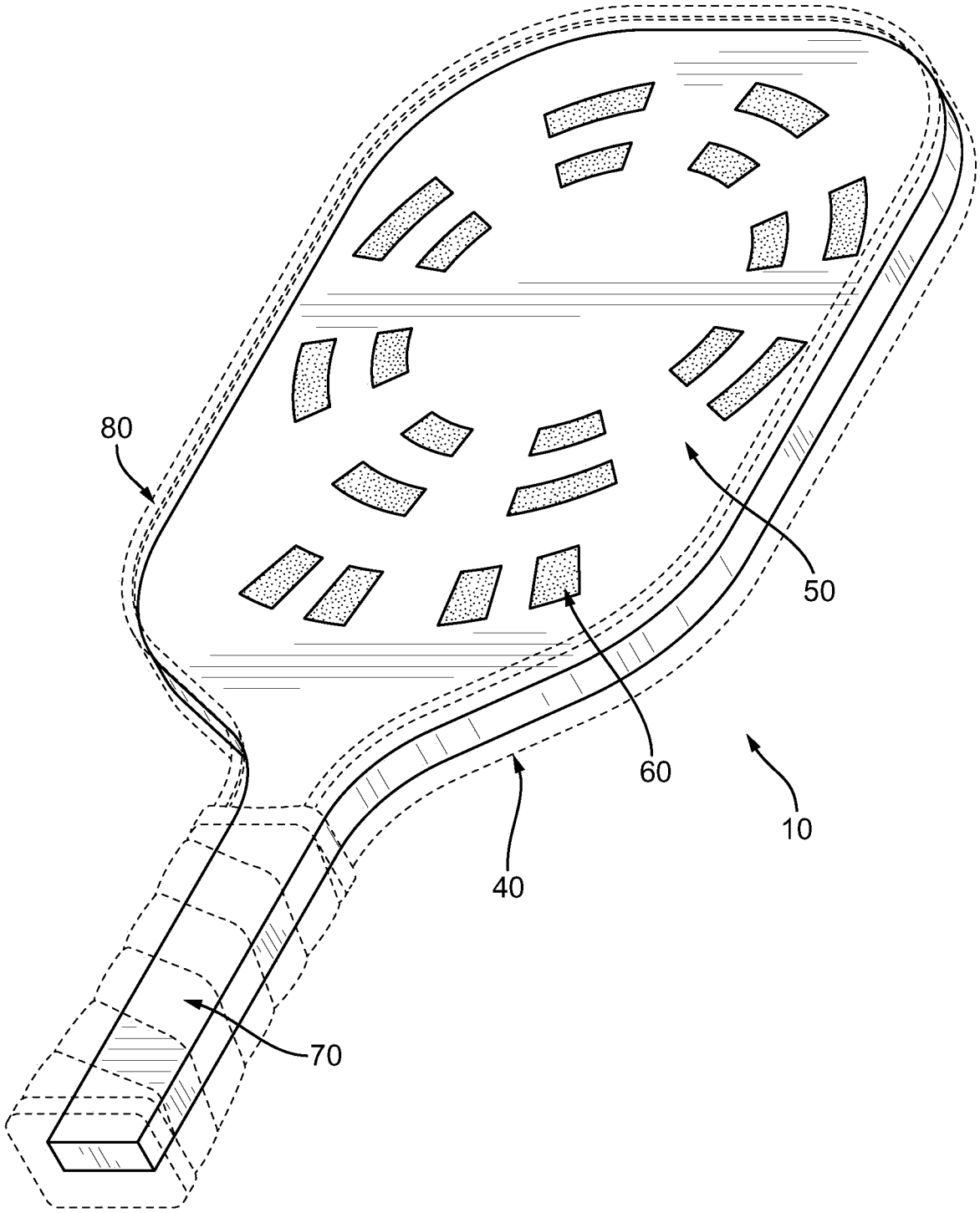
FIG. 7 depicts an example of a pickleball paddle with a third configuration for a skeleton, consistent with implementations of the current subject matter.

FIG. 7 provides an illustration of an embodiment, with skeleton 50 including two layers of concentrically oriented gaps filled with material 60. A row of four gaps which are also filled are positioned between the concentrically oriented gaps and the handle region. A larger non-gap region is formed in the center of the concentric gaps.

Figure 8:
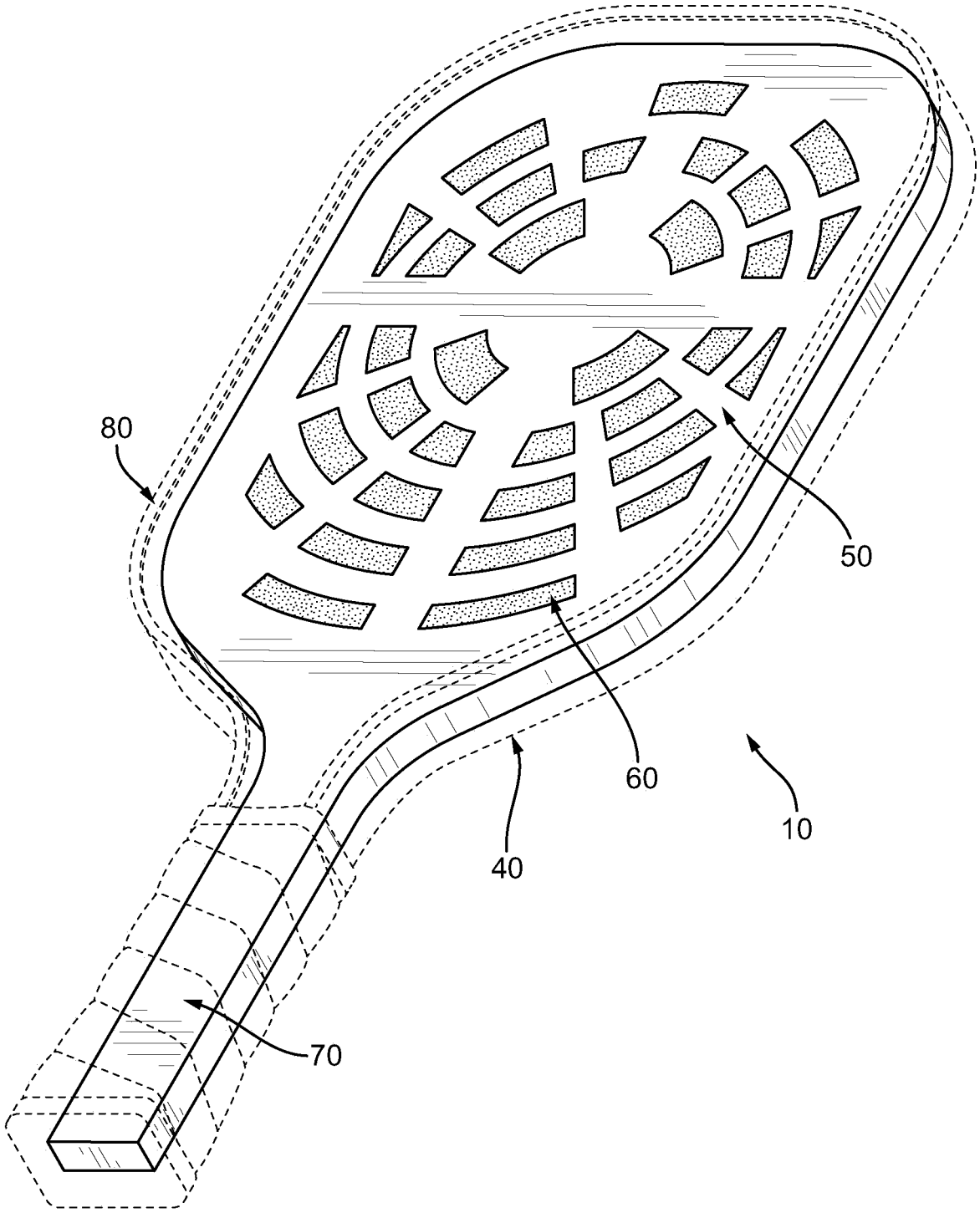
FIG. 8 depicts an example of a pickleball paddle with a fourth configuration for a skeleton, consistent with implementations of the current subject matter.

FIG. 8 provides an illustration of an embodiment with a skeleton 50 including concentrically oriented gaps having substantially trapezoidal or rounded trapezoidal shapes. The gaps are oriented so as to create a non-gapped central area that is offset from the center of the paddle. The handle 70 is also displayed.

Figure 9:
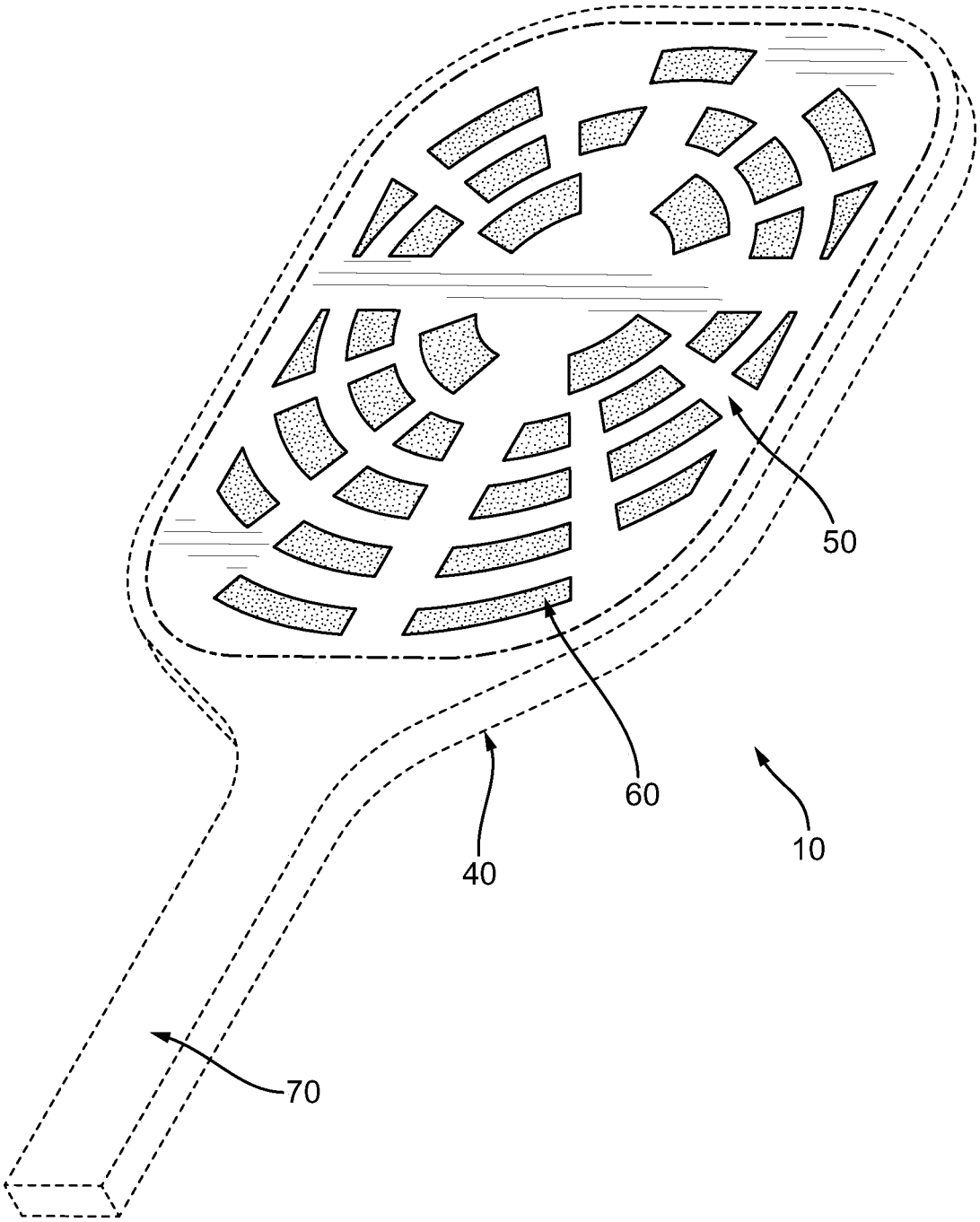
FIG. 9 depicts an example of a pickleball paddle with a fifth configuration for a skeleton, consistent with implementations of the current subject matter.

FIG. 9 provides an illustration of the embodiment of FIG. 8 without showing handle 70. As shown in FIGS. 8 and 9, a skeleton 50 can include gaps having various shapes including: trapezoidal, curved trapezoidal, triangular, rectangular and the like.

Figure 10:
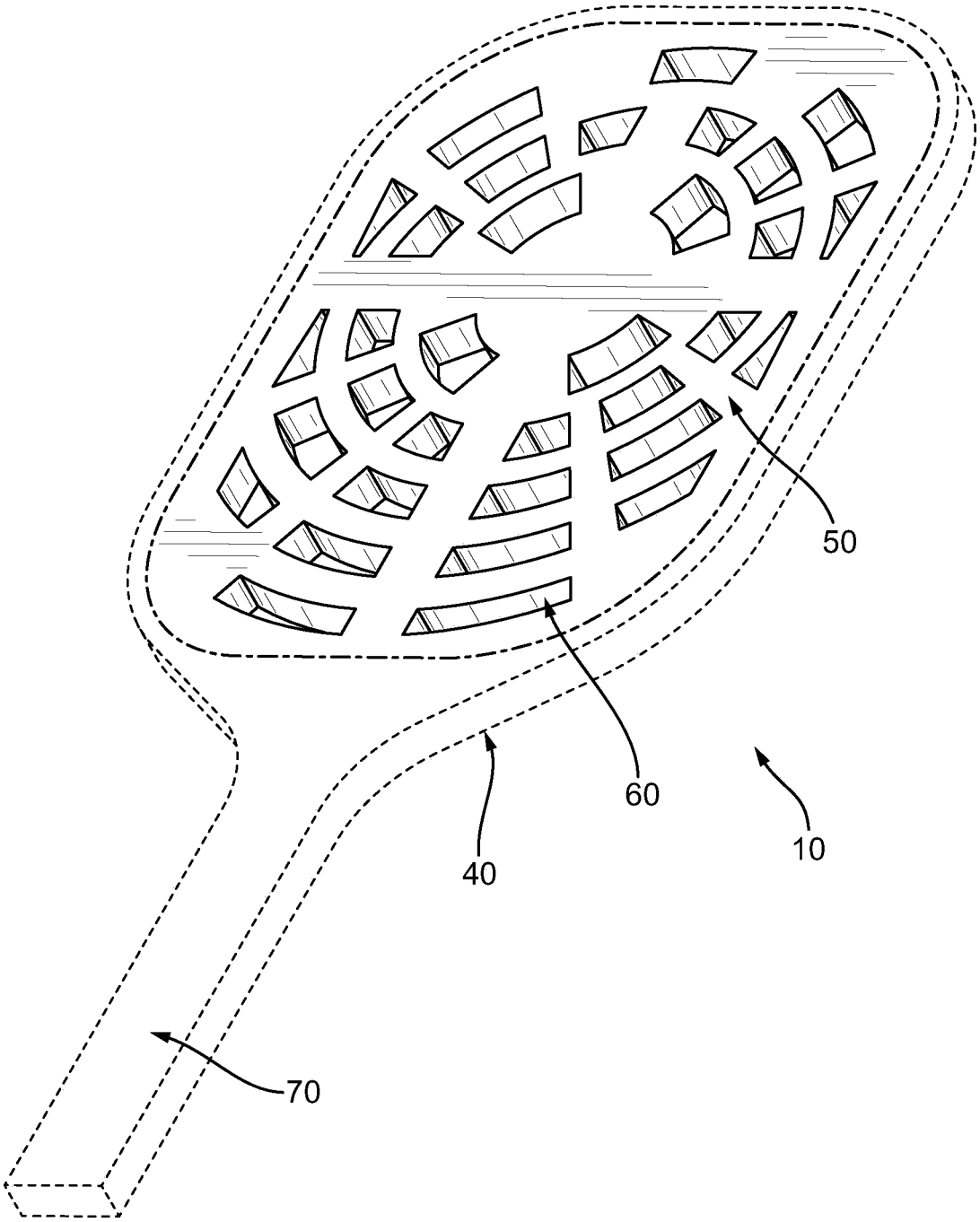
FIG. 10 depicts an example of a pickleball paddle with a sixth configuration for a skeleton, consistent with implementations of the current subject matter.

FIG. 10 provides an illustration of an embodiment with skeleton 50 having a plurality of gaps 90. The illustrated gaps 90 can be hollow and filled with air. Gaps can have various shapes including but not limited to trapezoidal, curved trapezoidal, triangular, rectangular and the like.

Figure 11:
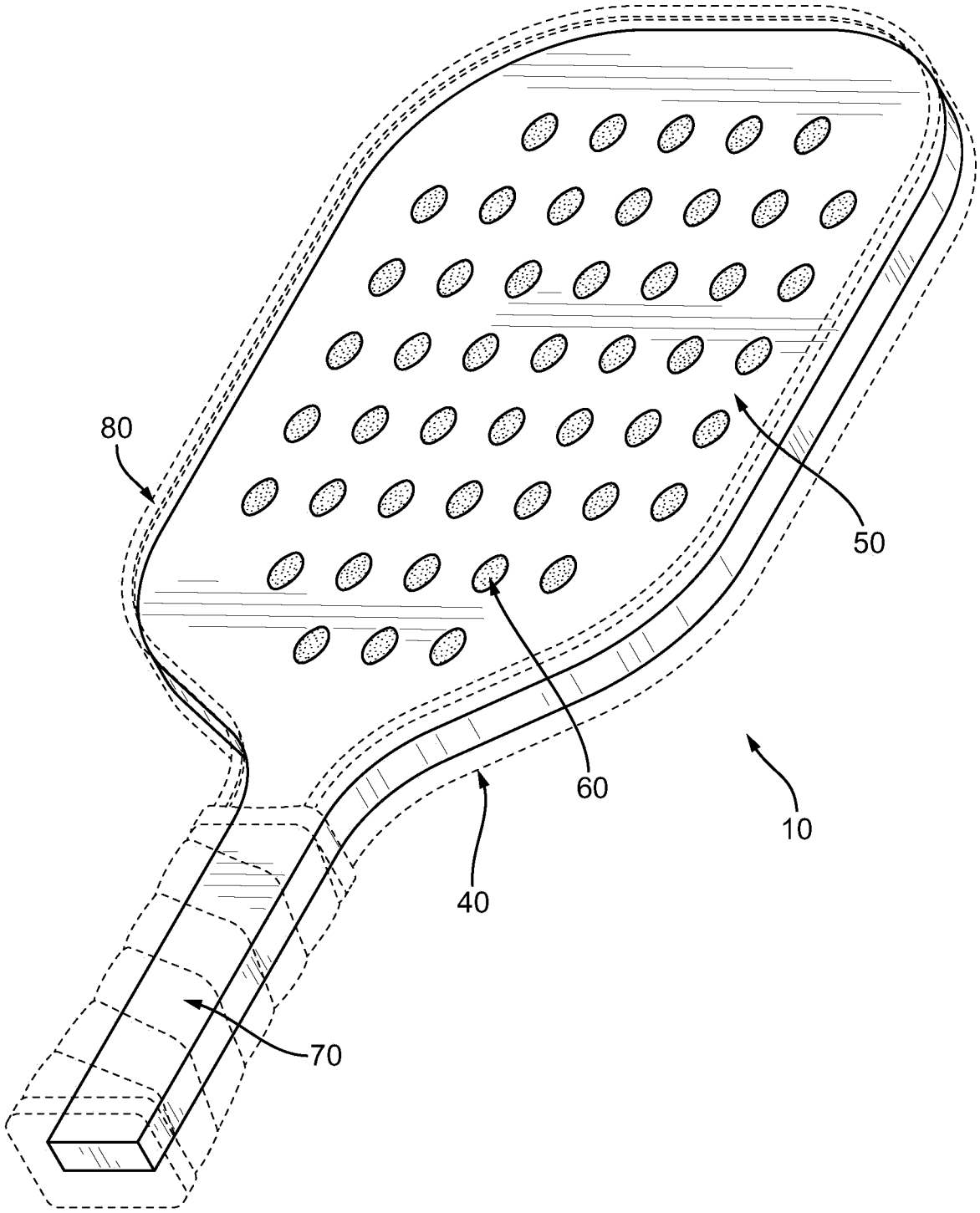
FIG. 11 depicts an example of a pickleball paddle with a seventh configuration for a skeleton, consistent with implementations of the current subject matter.

FIG. 11 provides an illustration of an embodiment with skeleton 50 having a plurality of gaps that are substantially circular and filled with material 60.

Figure 12:
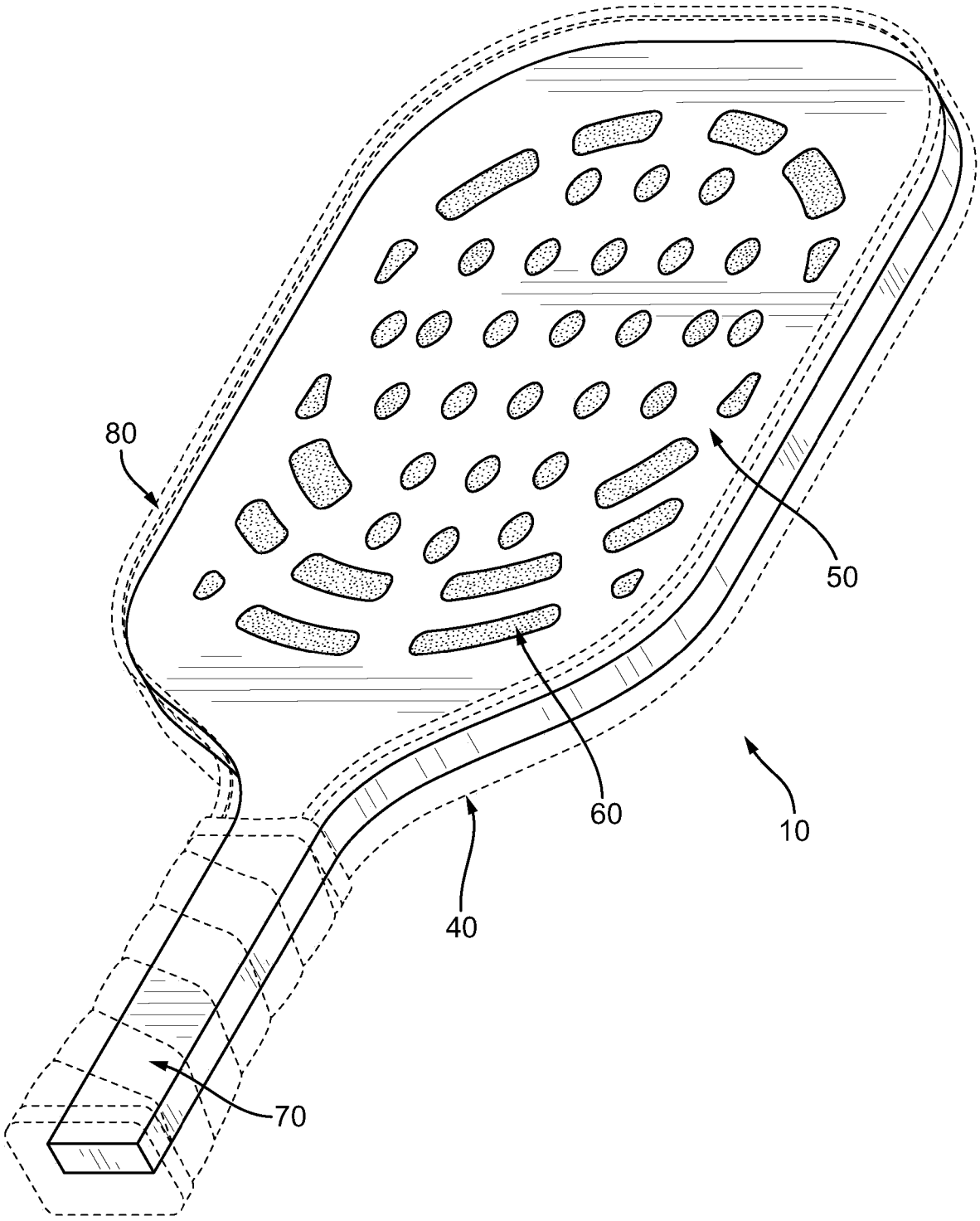
FIG. 12 depicts an example of a pickleball paddle with an eighth configuration for a skeleton, consistent with implementations of the current subject matter.

FIG. 12 provides an illustration of an embodiment with skeleton 50 having a plurality of gaps that are substantially circular about a central area of the paddle 10. The circular gaps are surrounded by a plurality of rectangular gaps of varying sizes. The illustrated gaps are shown as being filled with material 60.

Figure 13:
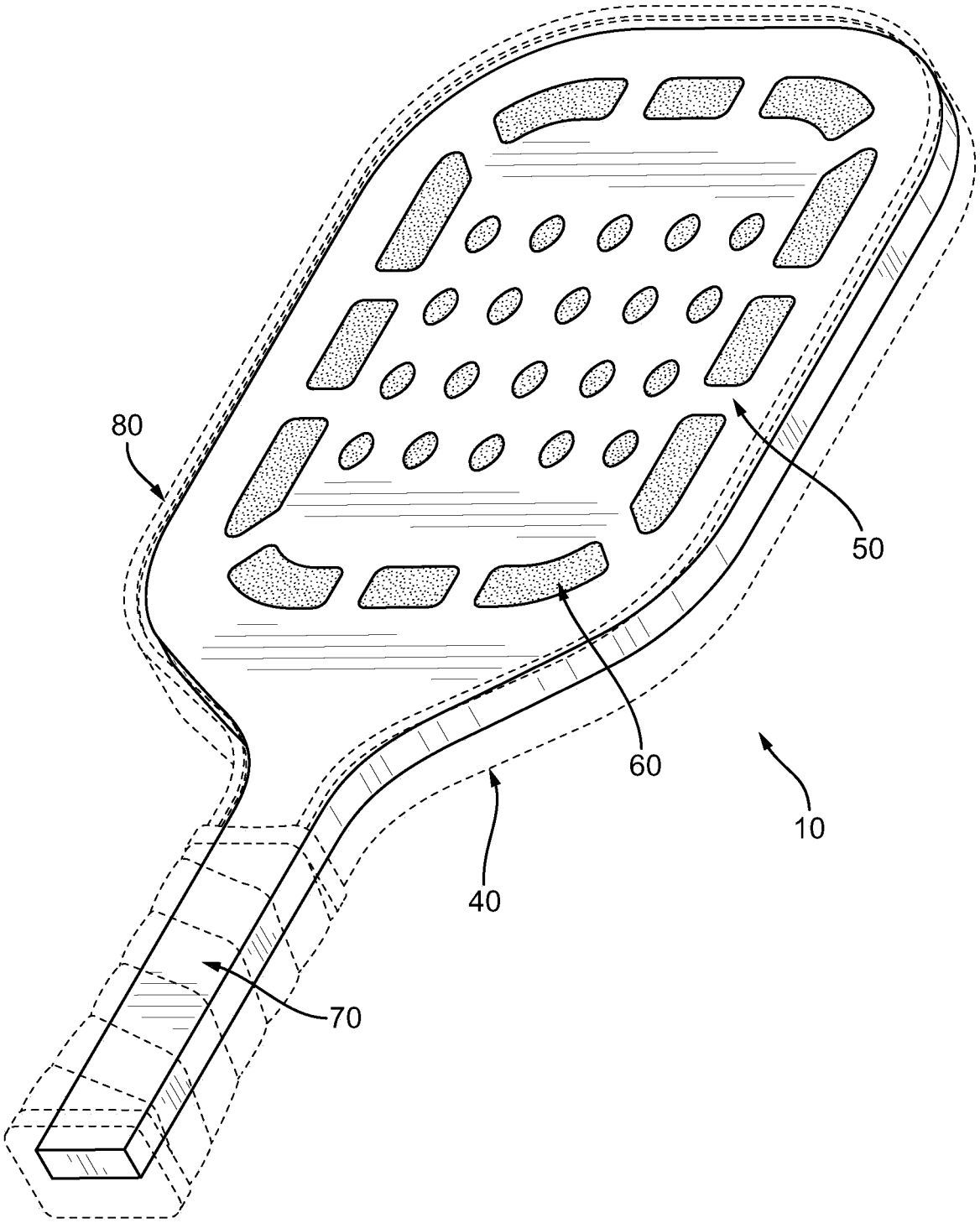
FIG. 13 depicts an example of a pickleball paddle with a ninth configuration for a skeleton, consistent with implementations of the current subject matter.

FIG. 13 provides an illustration of an embodiment with skeleton 50 having a plurality of gaps that are substantially circular organized in a substantially rectangular grid in a central area of the paddle 10. The circular gaps are surrounded by a plurality of rectangular gaps of varying sizes that form a rounded-square perimeter around the circular gaps. The illustrated gaps are shown as being filled with material 60.

Among the disclosure herein, provided herein are improved paddles, including with novel core materials and designs. For example, cores using lightweight foam materials. Such materials can include one or more materials. One or more materials can be used. Whether one material is used or multiple materials, the materials can be configured to have different weight and/or density characteristics such that the core can have dual or multiple densities of material.

Without being bound by theory, it is believed that the shape and/or feature distribution may affect the function of the paddle 10. For example, the placement of the skeleton 50 may affect performance when using the paddle, including spin (e.g. amount of spin put on the ball), speed, weight, weight distribution, position of the sweet spot, and the like. The sweet spot may be defined as the center of mass of the paddle or may be defined as the "center of percussion" (cp). In some embodiments, the sweet spot may provide additional control or precision when striking a ball that makes contact with the sweet spot. In some embodiments, the sweet spot may provide additional force when striking a ball that makes contact with the sweet spot. In some embodiments the sweet spot may provide a favored combination of rotation, speed, and/or trajectory, when striking a ball that makes contact with the sweet spot.

Some embodiments relate to a method of making and/or manufacturing a pickleball paddle, as claimed, shown and/or described herein.

Some embodiments relate to a method of using or playing with the paddle or article described herein. Such methods can include using a paddle or other article as described, claimed or shown herein to strike an object such as a ball.

It is envisioned that embodiments of the present disclosure can include skeletons with various gap configurations. The skeleton, and/or gaps can be composed of foam having varying density within the same embodiment of the paddle. For example, a skeleton can include areas filled with high density foam and areas filled with low density foam within the same paddle. High density foam can provide weight, stability, and resistance from deflection to a user. However, foam densities can be regulated by competitive sport associations. Low density foam can be used to provide power and sound dampening. Alternatively, gaps filled with air, or forming a void passage, can be used for power and/or sound dampening.

Embodiments of the present disclosure can include pickleball paddles having a specified rigidity. For example, pickleball paddles can be built with a rigidity corresponding to a deflection of 5 thousandths of an inch or less at a test weight of 3 kg. In some embodiments, pickleball paddles built in accordance with the methods described herein can have a deflection of 10 thousandths of an inch or less at a test weight of 5 kg. In some embodiments, target deflection ranges for a pickleball paddle may correspond to requirements of sports governing bodies such as the USA Pickleball (USAP). In some embodiments, deflection in inches per weight can be indicative of how quickly a ball making contact with the pickleball paddle departs from the paddle face upon contact. In some embodiments, deflection testing for the paddle can be between about 0.003 inches to 0.005 inches.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. For example, the logic flows may include different and/or additional operations than shown without departing from the scope of the present disclosure. One or more operations of the logic flows may be repeated and/or omitted without departing from the scope of the present disclosure. Other implementations may be within the scope of the following claims.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. References to a structure or feature that is disposed "adjacent" another feature may have portions that overlap or underlie the adjacent feature.

Spatially relative terms, such as, for example, "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

As used herein in the specification and claims, including as used in the examples and unless otherwise expressly specified, all numbers may be read as if prefaced by the word "about" or "approximately," even if the term does not expressly appear. The phrase "about" "or "approximately"

may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, in some implementations, the phrase "approximately" may include +/−0.03 mm, +/−0.05 mm, or the like.

What is claimed is:

1. A paddle comprising:

a core comprising:

a continuous layer comprising a first material comprising a high density composite foam comprising expanded polypropylene (EPP) having a density of about 3.5 to 20 pounds per cubic feet, wherein the core has a total weight between 2 and 4 ounces, and one or more regions embedded within the continuous layer that are lacking the first material and are at least partially filled with a filling comprising a second material.

2. The paddle of claim 1, wherein the high density composite foam further comprises at least one of ethylene-vinyl acetate (EVA), nanocarbon containing polymer composite foam (NCP), or microcellular polypropylene (MPP).

3. The paddle of claim 1, wherein the high density composite foam further comprises at least one of an elastomer, a polystyrene, a polyethylene, a polypropylene, a polyamide, a polyurethane, an ethylvinyl-acetate, a polyethylene oxide, a polyacrylate, a cellulose, an ethylene vinyl alcohol, a polybutylene, a polycaprolactone, a polycarbonate, a polyketone, polyester, a polylactic acid, a polyvinyl chloride, a polyphenylene, and copolymers thereof.

4. The paddle of claim 1, wherein the second material is air.

5. The paddle of claim 1, wherein one or more regions comprises a plurality of regions.

6. The paddle of claim 1, wherein the second material is a high density composite foam having a different density than the high density composite foam of the first material.

7. The paddle of claim 1, wherein each of the one or more regions spans an entire depth of the core.

8. The paddle of claim 1, wherein each of the one or more regions spans a partial depth of the core.

9. The paddle of claim 1, wherein a subset of the one or more regions is oriented on a perimeter of the paddle.

10. The paddle of claim 1, wherein a subset of the one or more regions is oriented in a grid on a face of the paddle.

11. The paddle of claim 1, further comprising:

a carbon fiber face adhesively attached to the core;

a grip; and/or a perimeter wrap.

12. The paddle of claim 1, wherein the paddle has a weight of between about 5-10 ounces.

13. The paddle of claim 1, wherein the one or more regions form one or more geometric shapes.

14. The paddle of claim 13, wherein the geometric shape comprises at least one of a circle, a square, an oval, a trapezoid, a triangle, or any combinations thereof.

15. The paddle of claim 1, wherein the paddle comprises a deflection less than 5 thousandths of an inch at a test weight of 3 kg.

16. The paddle of claim 1, wherein the paddle comprises a deflection less than 10 thousandths of an inch at a test weight of 5 kg.

17. The paddle of claim 1, wherein the one or more regions comprise at least one opening at a face of the core.

18. The paddle of claim 1, wherein the core comprises a head region and a handle region, and the continuous layer spans the head region and the handle region.

19. The paddle of claim 1, wherein the first material comprises the high density composite foam comprising expanded polypropylene (EPP) having a density of about 5 to 20 pounds per cubic feet.

20. The paddle of claim 1, wherein the first material comprises the high density composite foam comprising expanded polypropylene (EPP) having a density of about 6 to 20 pounds per cubic feet.

21. The paddle of claim 1, wherein the second material comprises a high density composite foam comprising expanded polypropylene (EPP) having a density of about 0.5 to 5 pounds per cubic feet.

22. The paddle of claim 1, wherein the second material comprises a high density composite foam comprising expanded polypropylene (EPP) having a density of about 0.5 to 3.5 pounds per cubic feet.

23. The paddle of claim 1, wherein the second material comprises a high density composite foam comprising expanded polypropylene (EPP) having a density of about 1 to 6 pounds per cubic feet.

24. A core for a pickleball paddle comprising:

a sheet of a first material, the sheet comprising at least one high-density composite foam comprising expanded polypropylene (EPP) having a density of about 3.5 to 20 pounds per cubic feet, wherein the core has a total weight between 2 and 4 ounces; and one or more regions embedded within the sheet that are lacking the first material and are at least partially filled with a filing comprising a second material.

25. The core of claim 24, wherein the core is in a pickleball paddle.

26. The core of claim 24, wherein the one or more regions form one or more geometric shapes.

27. The core of claim 26, wherein the geometric shape comprises at least one of a circle, a square, an oval, a trapezoid, a triangle, or any combinations thereof.

28. The core of claim 24, wherein the second material is air.

29. The core of claim 24, wherein the second material comprises a second high-density composite foam having a different density than the at least one high-density composite foam of the first material.

30. The core of claim 24, wherein the at least one high-density composite foam further comprises at least one of ethylene-vinyl acetate (EVA), nanocarbon containing polymer composite foam (NCP), microcellular polypropylene (MPP), an elastomer, a polystyrene, a polyethylene, a polypropylene, a polyamide, a polyurethane, an ethylvinyl-acetate, a polyethylene oxide, a polyacrylate, a cellulose, an ethylene vinyl alcohol, a polybutylene, a polycaprolactone, a polycarbonate, a polyketone, polyester, a polylactic acid, a polyvinyl chloride, a polyphenylene, and copolymers thereof.

31. The core of claim 24, wherein each of the one or more regions spans an entire depth of the core.

32. The core of claim 24, wherein each of the one or more regions spans a partial depth of the core.

33. The core of claim 24, wherein the core has a total weight of between 2 and 4 ounces.

34. The core of claim 24, wherein the one or more regions comprise at least one opening at a face of the core and the core comprises a head region and a handle region.

35. A paddle comprising:

a core having a head region and a handle region, the core comprising:

a continuous layer comprised of a first material comprising a high density composite foam comprising expanded polypropylene (EPP) with a density of about 3.5 to 20 pounds per cubic foot and a total weight between 2 and 4 ounces, and one or more regions embedded within the continuous layer that are lacking the first material and are at least partially filled with a filling comprising a second material, wherein the one or more regions comprise at least one opening at a face of the core.

* * * * *